United States Patent [19]

Flisikowski et al.

[11] 4,128,781

[45] Dec. 5, 1978

[54] X-RAY TUBE

[75] Inventors: Peter Flisikowski; Horst Peemöller, both of Hamburg, Fed. Rep. of Germany

[73] Assignee: U.S. Philips Corporation, New York, N.Y.

[21] Appl. No.: 767,652

[22] Filed: Feb. 10, 1977

[30] Foreign Application Priority Data

Feb. 25, 1976 [DE] Fed. Rep. of Germany ..... 2607618

[51] Int. Cl.[2] ..... H01J 35/04

[52] U.S. Cl. ..... 313/60; 313/149

[58] Field of Search ..... 313/60

[56] References Cited

U.S. PATENT DOCUMENTS

| | | | |
|---|---|---|---|
| 2,499,545 | 3/1950 | Van Der Tuuk et al. | 313/60 X |
| 3,230,409 | 1/1966 | Farrell | 313/60 |
| 3,714,487 | 1/1973 | Jacob | 313/60 |
| 4,068,127 | 1/1978 | Goodenough | 313/60 X |

*Primary Examiner*—Rudolph V. Rolinec
*Assistant Examiner*—Darwin R. Hostetter
*Attorney, Agent, or Firm*—Thomas A. Briody; Algy Tamoshunas

[57] ABSTRACT

An X-ray source having a cathode rotatable relative to the anode and a motor for rotating the cathode to produce a corresponding rotation of the X-ray beam emitted by the source.

2 Claims, 1 Drawing Figure

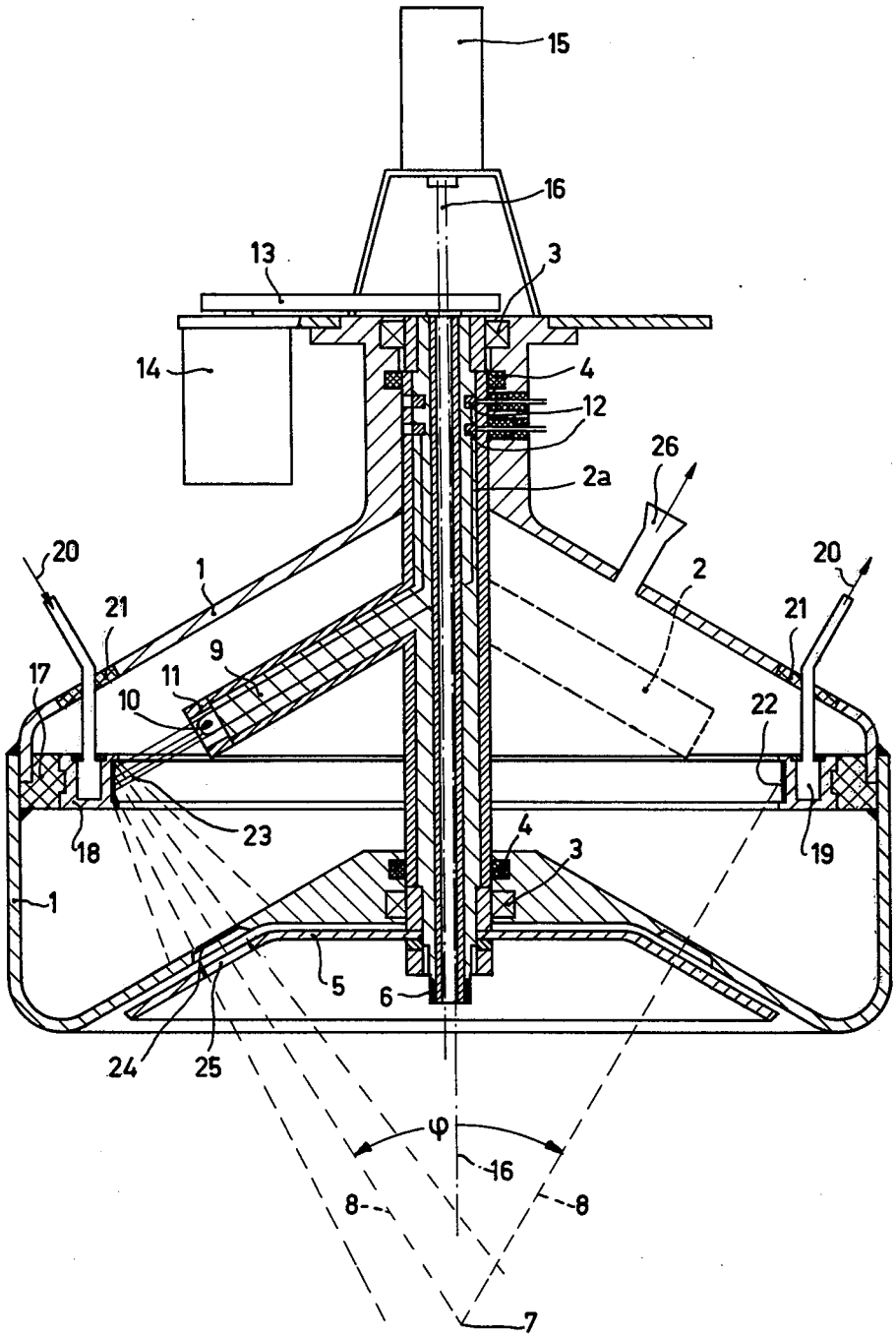
15
16
13
3
14
4
12
26
2a
20
1
2
20
21
21
9
17
11
10
22
23
18
19
4
3
1
5
6
24
25
φ
16
8
8
7

X-RAY TUBE

The invention relates to an X-ray source comprising drive means for realizing relative movement between a cathode and an anode of the source.

Known X-ray tubes have a common aspect in that the position of the focus, as viewed in space, is fixed. Even when rotary anodes are used, the position of the focus in space does not change; it changes only relative to the rotary anode. In many applications of X-ray sources, however, it is desirable to have a location-variable focus, which in prior art tubes is effected by displacing the entire X-ray tube. Such a movement of the X-ray source takes place, for example, in the case of tomography where the X-ray source is displaced over an arc of a circle during the exposure, or in the case of tomosynthesis exposures, where an X-ray radiator is successively positioned in different, exactly defined positions. A moving X-ray radiator is also preferably used also for radiation therapy.

Such a movement of an X-ray radiator has the drawback that accurate movements particularly, such as required for tomosynthesis, can be achieved only by comparatively expensive and heavy mechanisms. In such devices, the heavy weight of the X-ray radiator must be supported by stable guide elements with the detrimental effect of the bearing play in the guide elements being intensified by the length of the guide arms. As a result, mechanical vibrations can occur in the X-ray radiator which cause blurred X-ray images or positioning errors which cannot be compensated for.

The object of the invention is to provide an X-ray tube in which displacement of the focus in space can be realized without having to move the X-ray tube itself. To this end, an X-ray source of the kind set forth is provided with drive means for imparting a preferably arcuate movement to the cathode.

Because the source need no longer be moved to obtain a moving focus, a much lighter and hence cheaper mounting device may be used for supporting the source. In a preferred embodiment of the invention, accurate stopping of the X-radiation emitted by the location-variable focus is possible. A further preferred embodiment in accordance with the invention is particularly suitable for tomosynthesis, where individual exposures are made in different, exactly defined positions of the X-radiator and of the film cassette, with the exposures being subsequently superposed. The film cassette can then be shifted in the opposite direction relative to the X-ray radiator by a suitable step motor. A further embodiment in accordance with the invention comprises a particularly advantageous power supply for the filament of the cathode. A further preferred embodiment of the invention comprises an aperture arrangement whereby the emitted radiation can be converged in a point. This arrangement is particularly suited for radiation therapy as well as for tomography and tomosynthesis. In a final preferred embodiment of the invention, means are provided for accurate alignment of the X-ray tube.

A few preferred embodiments will hereinafter be described in detail with reference to the drawing.

Reference character 1 in the drawing denotes a glass or metal envelope of an X-ray tube. The rotation-symmetrical envelope is provided with openings in a symmetry axis with a hollow cylindrical shaft 2a projecting through the openings and supported in to the tube envelope by bearings 3. Seals 4 provided in the openings ensure a suitable vacuum in the interior of the tube envelope. The interior of the tube can be evacuated through a pump connection 26 provided in the envelope 1. A vacuum pump (not shown) is preferably connected to this connection during operation of the X-ray tube.

The rotary shaft 2a supports a cathode body 2 which is preferably shaped as a truncated hollow cone. On an edge remote from the rotary shaft, the cathode body is provided with a cathode filament 10 which is enclosed by a Wehnelt cylinder 11. Electrical supply leads for the cathode filament pass through the cathode body 2 and through the wall of the hollow cylindrical rotary shaft 2a to a slip ring device 12, the contacts of which can be connected through the tube envelope to a voltage source (not shown). Like the walls of the rotary shaft, the interior 9 of the cathode body is made of an insulating material. The outer surface of the cathode body is preferably metallic and carries cathode potential. Alternatively it is possible to use a plurality of different cathode filaments. The use of different cathode filaments enables focusses of different intensity to be produced. When a number of filaments for the same radiation intensity are provided on the edge of the cathode body in a uniformly distributed manner, a shift of the focus can be obtained without rotation of the cathode body by successively switching the filaments on and off.

A supporting ring 17 is disposed approximately in the centre (in the axial direction) of the tube envelope 1. The ring 17 supports an anode ring 18 and is made of an insulating material if the envelope is made of metal. The anode ring 18, which is preferably made of copper for proper heat conduction, is cooled with liquid, for example, via a hollow space 19. The cooling liquid flows through inlet and outlet connections 20, each passing through the tube envelope 1 and an intermediate insulator 21. An inner jacket 22 of the anode ring 18 is provided with a layer of tungsten or a tungsten rhenium alloy. The X-radiation is generated in this layer by the electrons emitted by the cathode.

A step motor 14 is connected to an upper end of the tube envelope. The motor drives the rotary shaft 2a, and rotates via an intermediate drive 13, the cathode either continuously or rotates it into different, properly defined positions. The high voltage and hence the X-radiation, can be switched on in each of these positions of the cathode. The focus then travels in a corresponding manner on the interior of the anode ring, and the emitted radiation penetrates through a window 24 provided in a bottom portion of the tube envelope. The radiation beam is suitably stopped by an apertured plate 5 which is made of a radiation-impermeable material. The plate 5 is provided with a bore 25 and is connected to the rotary shaft. The X-ray beam thus has a conical shape with an opening angle $\phi$ and a cone apex 7. The centering of the X-ray tube on an object to be exposed or irradiated can be effected by means of an optical device, for example, comprising a laser 15 emitting a light beam 16 which intersects the point 7 through the hollow rotary shaft. Alternatively, a lower portion 6 of the hollow cylinder can be threaded, so that a center pointer can be screwed thereon, the length of the pointer being determined by the position of the point 7.

As has already been stated, the X-ray tube can be used for radiation therapy or for tomography. For these applications the cathode continuously rotates during the exposures or treatment. In the case of tomosynthesis, where a number of individual exposures are made from exactly defined directions and are subsequently superposed, it is desirable to displace the focus over a defined distance between exposures. The stop motor 14 is particularly suitable for this purpose. During the displacement, the high voltage is preferably switched off. The X-ray tube in accordance with the invention is also suitable for X-ray stereo examinations where, for example, exposures are made from two diametrical positions.

The X-ray tube in accordance with the invention, can also operate with a stationary cathode and the the X-ray tube itself being moved, if desired. It is also possible to move the X-ray tube along a desired path with simultaneous rotation of the cathode.

The cathode of the X-ray tube shown in the drawing is driven by means of a step motor arranged outside the X-ray tube. In this configuration sealing problems for the passage of the rotary shaft occur and, moreover, a vacuum pump is required. These costs and efforts can be saved — as in the normal rotary anode X-ray tubes — by arranging a rotor in the tube envelope (which is in any case connected to the cathode) and by arranging a stator which drives the rotor outside the X-ray tube on the tube envelope.

What is claimed is:

1. An x-ray source comprising an envelope, an annular anode having an inner surface arranged in said envelope, a shaft mounted in said envelope for rotation about an axis coaxial with the axis of said anode, a cathode supported on said shaft for movement therewith along a circular path about said axis of rotation, said cathode being arranged to emit a beam of electrons onto the inner surface of said annular anode to produce a beam of X-ray radiation directed towards said axis of rotation so that upon movement of said cathode along said path, said X-ray beam traverses a generally conical path with the apex thereof lying along said axis of rotation, and means for rotating said shaft.

2. An X-ray source according to claim 1 including a plate of material impermeable to X-ray radiation extending into the path of said X-ray beam, said plate being affixed to said shaft for rotation therewith and having an aperture for transmitting said X-ray radiation.

* * * * *